United States Patent [19]

Wright

[11] Patent Number: 4,815,736

[45] Date of Patent: Mar. 28, 1989

[54] PORTABLE BATTING CAGE AND METHOD OF ASSEMBLING SAME

[76] Inventor: Robert Wright, 4221 - 75th St., Des Moines, Iowa 50322

[21] Appl. No.: 888,806

[22] Filed: Jul. 24, 1986

Related U.S. Application Data

[63] Continuation-in-part of Ser. No. 720,008, Apr. 4, 1985, abandoned.

[51] Int. Cl.[4] ..... A63B 69/40

[52] U.S. Cl. ..... 273/26 A; 135/102; 273/181 F

[58] Field of Search ..... 273/26 R, 26 A, 29 A, 273/35 B, 181 R, 185 R, 181 F, 176 F, 176 B, 182 A; 135/102, 106, 108, 118, DIG. 8, DIG. 9, 104

[56] References Cited

U.S. PATENT DOCUMENTS

| | | | |
|---|---|---|---|
| 84,381 | 11/1868 | Seaman | 135/102 |
| 124,239 | 3/1872 | Winslow | 135/102 |
| 684,086 | 10/1901 | McCall | 135/102 |
| 758,642 | 5/1904 | Gotsche | 135/102 |
| 2,856,941 | 10/1958 | O'Neal | 135/102 |
| 3,052,249 | 9/1962 | Seaman et al. | 135/104 |
| 3,171,417 | 3/1965 | Stokes | 135/102 |
| 3,188,478 | 8/1921 | Nelson | 135/102 |
| 3,223,098 | 12/1965 | Dole, Jr. | 135/104 |
| 3,820,553 | 6/1974 | Huddle | 135/103 |
| 3,970,096 | 7/1976 | Nicolia | 135/104 |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

An elongated, portable cage is constructed from a plurality of arcuately shaped frame members to which a net is secured so as to form an arch shaped enclosure. Anchoring cables are attached to the frame members and the support surface so as to maintain the frame members in an upright position. The frame members are formed by a plurality of releasably coupled plastic pipes. The net includes a plurality of sleeves through which the frame members extend. The cage can be used either indoors or out of doors and maintains the environmental conditions on the interior of the enclosure. A floor mat permits the cage to be erected indoors without causing damage to the floor covering. The net is secured to the frame so as to hang loosely therefrom. The frame members are formed of material of such flexibility as to be laterally and longitudinally movable such that the impact energy of a ball hitting the net and/or frame members will be absorbed without substantial ricocheting of the ball.

32 Claims, 9 Drawing Sheets

111
110
112

65
14
74
64F
62F
16
62E
14
60F
62D
14
62C
110
60E 14
62B
18
65
14
72
60D
63
36
60C
36
60B
64A
62A
60A
63
16
114
132
36

36
114
14
31
36
14
31
14
14
36
14
110
18

114
14

33
33
152
32
32
158A
14C
14B
156A
150
158B
156B
18
14B
144
142
18
18
14A
36
36
36
14B
14B
14B
36
144
34-34

14C
154
152
36
36

PORTABLE BATTING CAGE AND METHOD OF ASSEMBLING SAME

This application is a continuation-in-part of applicant's co-pending application, Ser. No. 720,008, filed Apr. 4, 1985, (abandoned).

BACKGROUND OF THE INVENTION various types of cage assemblies have been utilized to permit a baseball or softball player to take batting practice. Such cages typically include a net draped over but not attached to, a super structure so as to stop the batted balls. However, the super structure or framework of such cages is usually made from metal or other heavy material and is permanently anchored in the ground. Also, the use of such heavy framework presents a hazard to the batter and to others when a batted ball ricochets off the framework. Also, balls often get caught in the net due to the free hanging suspension of the net from the framework.

Furthermore, conventional batting cages are permanently erected out of doors and therefore cannot be used during inclement weather. It is also difficult to erect a batting cage indoors without damaging the floors.

Therefore, it is a primary objective of the present invention to provide an improved batting cage.

A further objective of the present invention is the provision of a portable batting cage which can be erected indoors or out of doors.

Another objective of the present invention is the provision of a floor mat for anchoring the framework of the batting cage and for protecting the floor of an indoor arena.

A further objective of the present invention is the provision of a batting cage which is portable.

Another objective of the present invention is the provision of a batting cage having a framework constructed of lightweight, shock absorbing plastic pipe.

Still another objective of the present invention is the provision of a batting cage which completely surrounds the user and which causes balls to drop straight downwardly when hit into the cage netting or framework.

A further objective of the present invention is the provision of a batting cage which minimizes the ricochet of the ball off the super structure.

Another objective of the present invention is the provision of a batting cage in which a one piece net is attached directly to the framework rather than being suspended over the framework.

Another objective of the present invention is the provision of a batting cage in which the stress along each arcuately shaped frame member is balanced.

A further objective of the present invention is the provision of a batting cage in which the environmental conditions outside of the cage are maintained within the cage.

A still further objective of the present invention is the provision of a batting cage having a shape which can be easily realigned and adjusted by adjusting the anchoring cables.

Still another objective of the present invention is the provision of a batting cage which can be used indoors or outdoors.

Another objective of the present invention is the provision of a batting cage which is not inhibitive to the batter.

Another objective of the present invention is the provision of a batting cage which simulates game conditions.

A further objective of the present invention is the provision of a batting cage which is easy to assemble and disassemble, and which is safe and durable in use.

SUMMARY OF THE INVENTION

The elongated portable batting cage of the present invention is comprised of a plurality of arcuately shaped frame members which are anchored to the floor or ground by a plurality of flexible cables or ropes. A single piece net is secured to the frame member so as to form an arch-shaped enclosure. Each frame member is made of a plurality of releasably coupled, high intensity, shock absorbing, lightweight plastic pipe. Each frame member is received in a boot having an enlarged base plate with a non-skid bottom surface for frictionally engaging the support surface or is placed over a stake secured in the ground. At least one cable or set of cables extends along the length of the batting cage and is secured to the support surface at points remote from the ends of the enclosure. A second set of cables is also attached to each frame member and secured to the support surface at a point remote from the sides of the enclosure. The net has a plurality of sleeves disposed therein and across the width thereof through which each frame member is extended for connecting the net to the framework.

To assemble the batting cage, the boots or stakes are positioned at predetermined points on the floor or ground. One of the frame members is inserted into each of the sleeves in the net such that the ends of the frame members protrude from each respective sleeve. A longitudinally extending cable is connected to the tops of the frame members, and one end of the cable is anchored to the support surface or ground. The first frame member is then stood up and placed into its respective receiving boots or over its respective stake. The remaining frame members are sequentially positioned and stood up in each respective boot or over each stake while maintaining tension on the longitudinal top cable. The opposite end of the longitudinal top cable is then secured to the support surface at the opposite end of the enclosure. Longitudinally extending side cables are then secured to the sides of the enclosure and anchored to the support surface. Finally, the plurality of laterally extending cables are connected to the frame members and anchored to the support surface. The steps are reversed to disassemble the batting cage. Also, once assembled, the cage can be collapsed in accordian-like fashion by removing the appropriate supporting cables.

Particularly when the batting cage is to be used indoors, it may be desirable to use a floor mat to anchor the frame members and to protect the floor. Each boot is received within a pocket in the mat and is held in place by Velcro straps which are secured over the boot. The use of the mat eliminates the need for the laterally extending support cables.

DETAILED DESCRIPTION OF THE DRAWINGS

Figure 1:
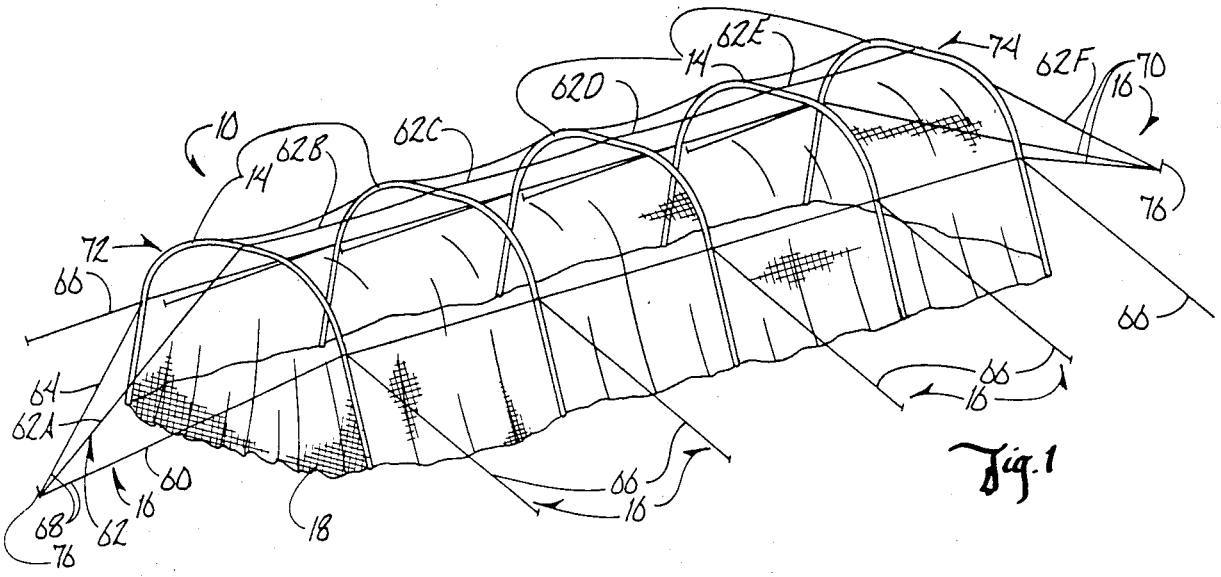
FIG. 1 is a perspective view of the batting cage of the present invention.
Figure 2:
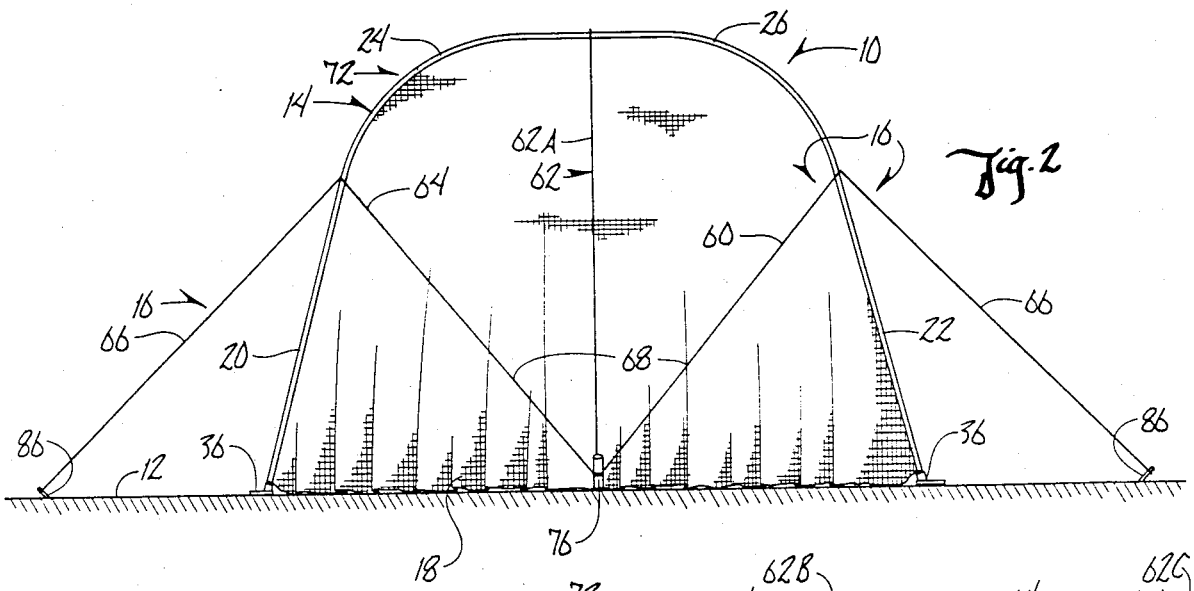
FIG. 2 is an end elevational view of the batting cage.
Figure 3:
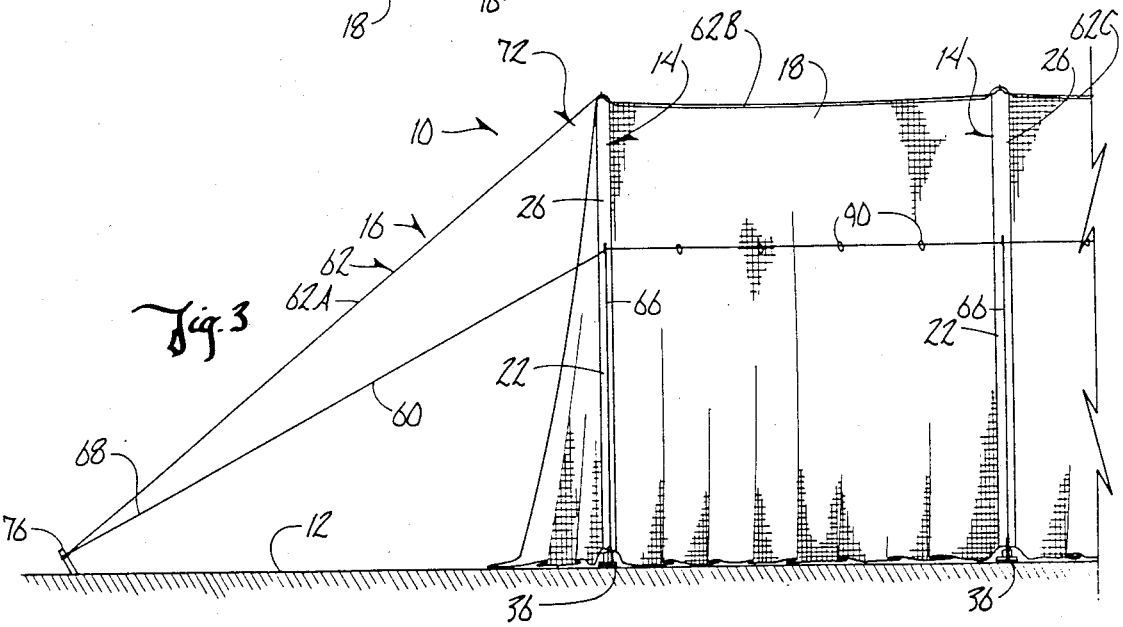
FIG. 3 is a partial side elevational view of the batting cage.
Figure 4:
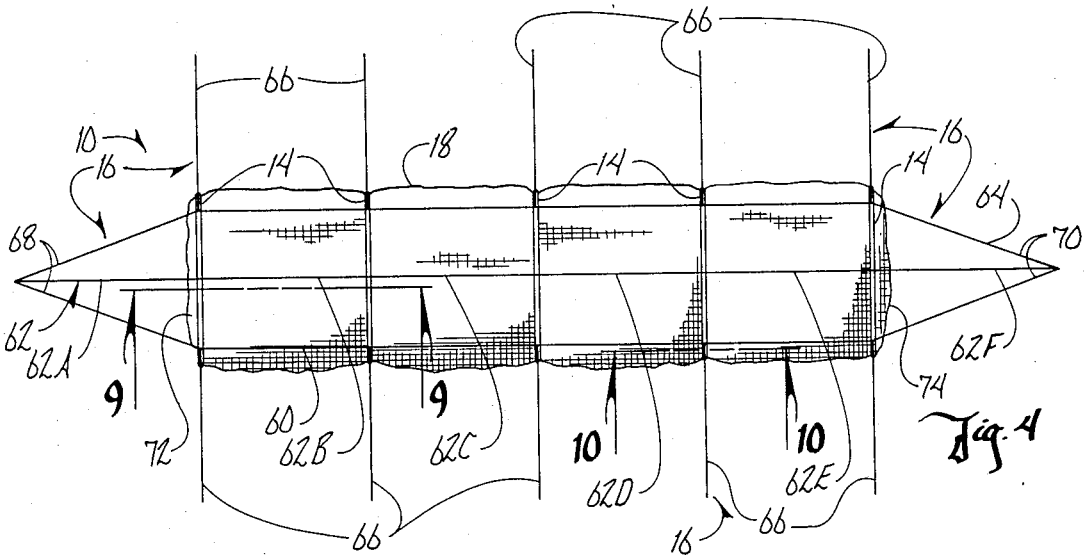
FIG. 4 is a top plan view of the batting cage.

The portable batting cage of the present invention is generally designated in the drawings by the reference numeral 10. Cage 10 can be erected on any support surface 12 either indoors or out of doors. Batting cage 10 is generally comprised of a plurality of arcuately shaped frame members 14, anchoring means 16 attached to frame members 14 and support surface 12 for maintaining the frame members in an upright position, and a net 18 secured to frame members 14 so as to form an elongated arch-shaped enclosure.

Figure 11:
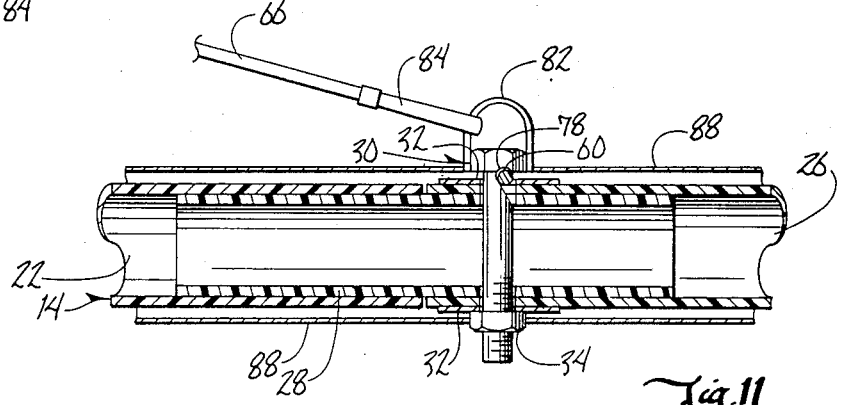
FIG. 11 is a partial sectional view taken along lines 11—11 of FIG. 10.

Each arcuate frame member 14 is constructed from a plurality of releasably coupled plastic pipes which are flexible, shock absorbing and lightweight. More particularly, each frame member 14 preferably has a pair of substantially straight opposite legs 20 and 22 and a pair of curved pipe segments 24 and 26. Each pipe section is hollow and coupled to the adjacent section by a reduced diameter coupler 28, as seen in FIG. 11. For example, coupler 28 is rigidly secured to leg 22 by glue or the like and extends therefrom so as to releasably receive curved segment 26. Curved segment 26 is locked against movement with respect to leg 22 by a lock bolt 30 extending through aligned apertures in curved segment 26 and coupler 28. A pair of saddle washers 32 are positioned on each side of curved pipe segment 26 to prevent lock bolt 30 from cracking the plastic pipe when nut 34 is tightened on bolt 28.

Figure 9:
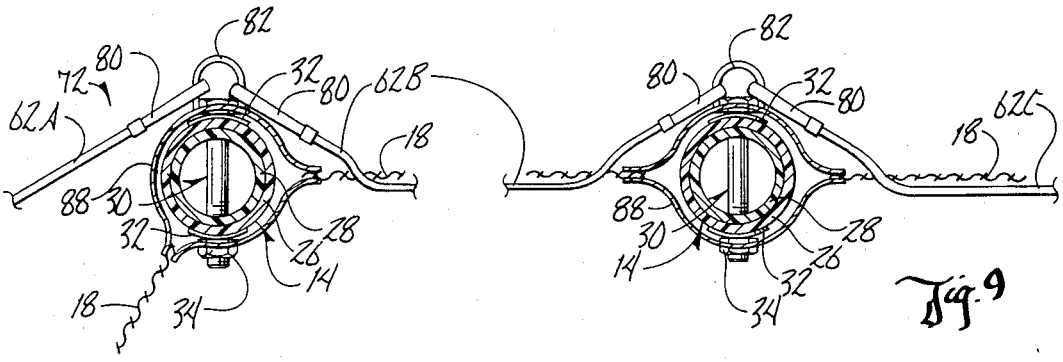
FIG. 9 is a partial sectional view taken along line 9—9 of FIG. 4.

A similar coupling assembly as shown in FIG. 11 and described above is provided at the juncture of leg 20 and curved pipe segment 24, and between the upper adjoining ends of curved segments 24 and 26, as seen in FIG. 9. It is understood that any other convenient coupling arrangement can also be used to join the pipes which form frame members 14.

Figure 6:
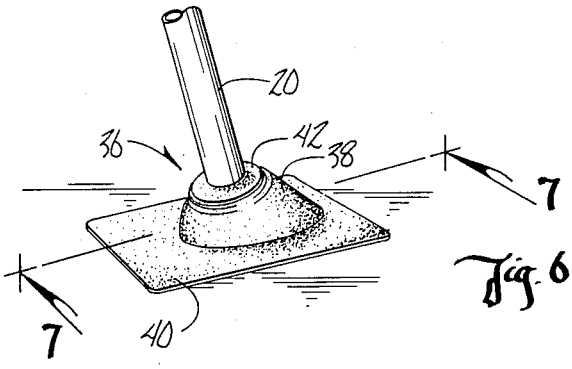
FIG. 6 is a perspective view of the support boot used for setting up the cage indoors.
Figure 8:
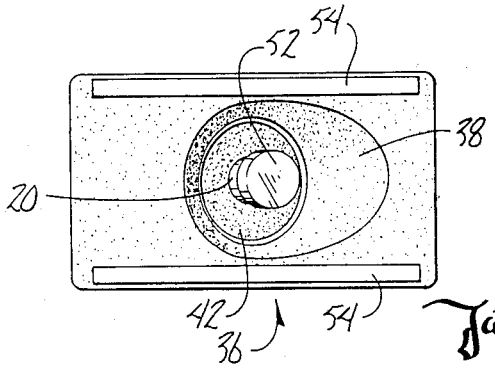
FIG. 8 is a bottom plan view of the leg and boot taken along lines 8—8 of FIG. 7.
Figure 7:
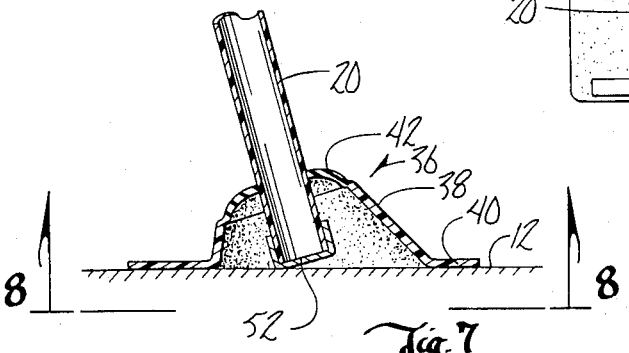
FIG. 7 is a sectional view of a leg and boot taken along lines 7—7 of FIG. 6.

When cage 10 is used indoors, the lower end of each frame leg 20 and 22 is positioned in a hollow leg boot 36. Boot 36 includes a leg receiving portion 38 and an enlarged plate member 40. Leg receiving portion 38 is angularly disposed with respect to plate member 40 as seen in FIGS. 6 and 7. Boot 36 is preferably constructed of rigid plastic material, except for top end 42 of portion 38 which is preferably made of flexible rubber material so as to permit minimal movement of the leg within boot 36 during assembly of cage 10. The lower ends of legs 20 and 22 are covered by a removable cap 52 to prevent damage to the indoors support surface 12. Non-skid material 54, such as double sided tape or the like, is fixed to the bottom of plate member 40 such that boot 36 will not slide upon support surface 12.

Figure 5:
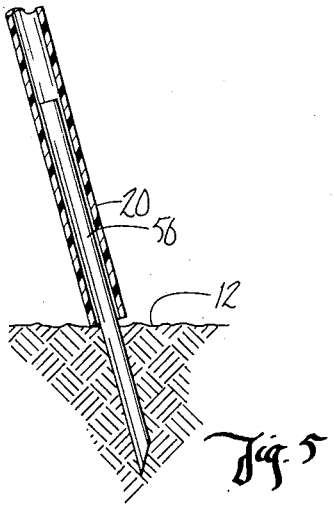
FIG. 5 is a side elevational sectional view of a ground stake over which the cage leg fits when the cage is erected outside.

When cage 10 is assembled out-of-doors, boots 36 are not required and hollow frame legs 20 and 22 may be placed directly over the respective upper protruding ends of stakes 56 which are anchored in the ground or support surface 12, as seen in FIG. 5.

Anchoring means 16 used in stabilizing frame members 14 in an upright position generally comprises a plurality of elongated, flexible first cable means 60, 62 and 64, extending along the length of the batting cage enclosure to provide longitudinal stability thereto, and a plurality of elongated flexible second cable means 66 extending laterally from the enclosure for lateral stability.

Figure 10:
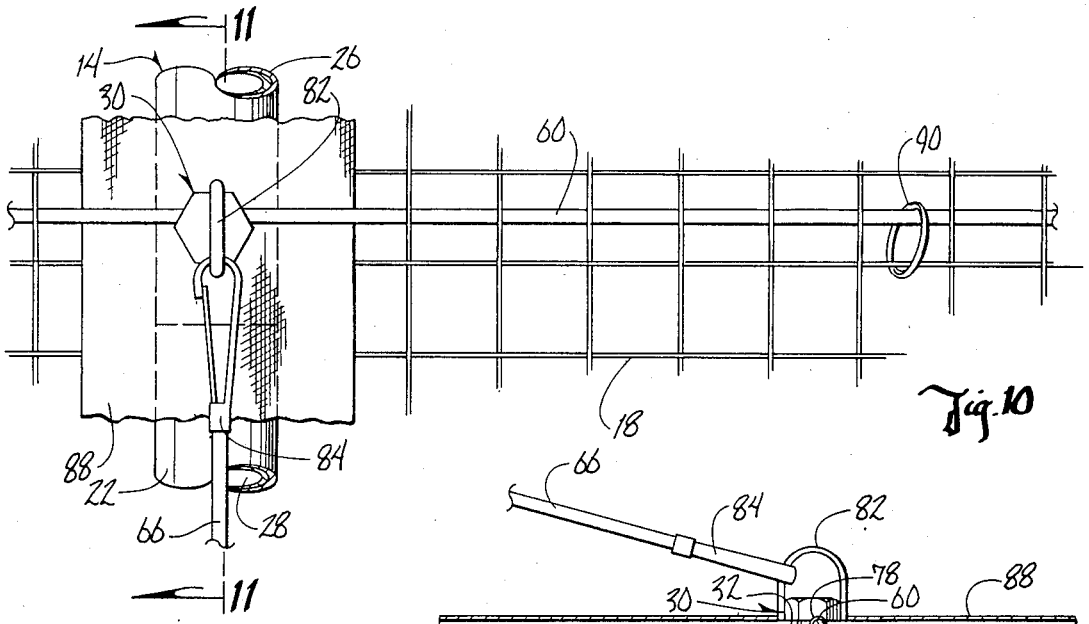
FIG. 10 is a partial view taken along lines 10—10 of FIG. 4.

Longitudinal cables 60 and 64 are identical to one another and preferably comprise a single length of cable having opposite ends 68 and 70 which are anchored at a point remote from the ends 72 and 74, respectively, of batting cage 10 by a stake 76 or in any other convenient manner. Longitudinal cables 60 and 64 extend along the sides of batting cage 10 and are received within a slot or notch 78 in lock bolt 30 adjacent the respective juncture of each leg 20 and 22 with curved segments 24 and 26. When nut 52 is tightened upon lock bolt 30, cables 60 and 64 are clamped in slot 78 between the head of bolt 30 and the adjacent saddle washer 32, so as to maintain the spaced relation between frame members 14. As seen in FIG. 10, cables 60 and 64 are positioned on the inside of net 18 except at each bolt 30 wherein the cable passes on the exterior of frame member 14.

In contrast to longitudinal cables 60 and 64, longitudinal cable 62 extending along the top of batting cage 10 preferably includes a series of shorter lengths of cable 62*a*, 62*b*, 62*c*, 62*d*, 62*e* and 62*f*. At least one end of cable lengths 62*a* and 62*f*, and both ends of cable lengths 62*b*, 62*c*, 62*d*, and 62*e* have a clip 80 attached thereto. Each clip 80 is fastened to a ring 82 fixed to the head of lock bolt 30. Cables 62*b–e* are preferably weaved through net 18, as best seen in FIG. 9. Cables 62*a* and 62*f* extend outwardly from the ends 72 and 74 of batting cage 10 and are secured to support surface 12 by stake 76.

While first cable means 60, 62 and 64 are preferably constructed and attached to batting cage 10 as described above, it is understood that all these cables could be similarly constructed and fastened to the batting cage, or that side cables 60 and 64 could be a plurality of shorter lengths of cables with top cable 62 being a single elongated cable, each being secured to batting cage 10 in the appropriate fashion.

The plurality of second cable means 66 provide lateral stability for batting cage 10. Each length of cable 66 includes a clip 84 at one end thereof which is fastened to ring 82 on lock bolt 30 at the respective joint of leg 20 and curved segment 24, or leg 22 and curved segment 26. The opposite end of cables 66 are anchored to support surface 12 by stakes 86 or in any other convenient manner.

Net 18 is generally rectangular in shape and includes a plurality of sleeves 88 extending across the width thereof. Net 18 and sleeves 88 are made of nylon or other weather-resistant material. Each sleeve 88 is adapted to receive one of frame members 14, as seen in FIGS. 9, 10 and 11, such that batting cage 10 maintains its arcuate shape. Sleeves 88 include slots or openings (not shown) therein to provide access to lock bolts 30. Velcro fastening material may be provided on such access slots or openings. The spacing between adjacent sleeves 88 is substantially equal to the length of cables 62*b–e*. A plurality of net clips or split rings 90 are snapped about cables 60 or 64 and a portion of net 18 to further maintain the shape of the batting cage enclosure.

The apertures in net 18 are sufficiently small to prevent a ball from passing therethrough, yet sufficiently large to maintain the external environmental conditions within the batting cage enclosure. Thus, the interior of batting cage 10 simulates actual game conditions, for example, when sun, rain or wind exists. Also, the inherent transparent nature of net 18 further simulates actual game conditions wherein the batter is in the presence of spectators and noise. Also, the permeability of net 18 to both the human eye and to the weather conditions permits batting cage 10 to be assembled out of doors without detracting from the aesthetics of the environment and without damaging or killing the grass located within batting cage 10.

To assemble batting cage 10, the proper positions of leg boots 36 or leg stakes 56 are marked on support surface 12. Net 18 is spread out over the markings such that the openings in sleeves 88 are facing upwardly. Frame members 14 are assembled by coupling leg 20 to curved segment 24, curved segment 24 to curved segment 26, and curved segment 26 to leg 22, via coupler 28 and lock bolt 30. Frame members 14 are then inserted into sleeves 88 in net 18 until the lower end of each leg extends from the respective sleeve. Each lock bolt 30 is positioned adjacent the slot in sleeve 88 with ring 82 thereof extending outwardly. Leg caps 52 are placed over the ends of the legs if cage 10 is being erected indoors.

Each longitudinal cable 62*a–f* is then attached to frame members 14 by snapping clips 80 to ring 82 on the respective lock bolt 30 at the juncture of curved frame segments 24 and 26 within the intermediate portion of the cable being weaved under or through net 18.

Next, boots 36 or stakes 56 are secured to the marked spacing on or in support surface 12. Stake 56 and leg receiving portions 38 of boots 36 are angled inwardly so as to receive legs 20 and 22. End stakes 76 are anchored in their proper position in support surface 12. The end frame member 14 to which cable 62*a* is attached is then positioned within the respective boot 36 or over the respective stake 56. The free end of cable 62*a* is then fastened to stake 76. The remaining frame members 14 are sequentially positioned into their respective boots 36 while maintaining tension on longitudinal cable 62 until the last frame member is in an upright position and the free end of the cable 62*f* is secured to the stake 76 at the opposite end of batting cage 10.

Longitudinal cables 60 and 64 are then weaved inside net 18 and outside net sleeves 88 and positioned within notches 78 in lock bolts 30. Nut 34 is tightened on bolt 30 so as to clamp cable 60 and 64 in place. Cables 60 and 64 may be marked at the appropriate place for positioning within each notch 78 of lock bolts 30. The ends of cables 60 and 64 are then fastened to end stakes 76. All the frame members should stand perpendicular to support surface 12. If one or more frame members ar not perpendicular to support surface 12, longitudinal cables 60 and 64 can be adjusted by loosening lock bolts 30 and moving the appropriate frame member or members to a perpendicular position. Lock bolts 30 are then re-tightened.

Clips 84 on lateral cables 66 are then snapped onto ring 82 of lock bolts 30 and the opposite end of the cables anchored to support surface 12 by stakes 86. Net 18 can be laterally adjusted so that there is substantially equal overhang on each side of cage 10. Finally, split rings 90 are placed around cables 60 and 64 and net 18 at the desired locations.

To disassemble the batting cage, the above steps are reversed.

Once batting cage 10 is initially erected, it can be collapsed in accordian-like fashion against a wall or fence 92 without complete disassembly, as seen in FIGS. 13–16. More particularly, while cage 10 is still standing, cross-cables 94 are secured between opposite legs 20 and 22 at the lower ends thereof for each frame member 14. End cables 60, 62*a* and 64 are unfastened at one end from end stake 76. Then, beginning with the frame member furthest from wall 92, frame members 14 can be sequentially removed from the respective boot 36 or stake 56, as the respective side cables 66 are released from support surface 12, and moved in a vertical orientation toward wall or fence 92. As an alternative to moving frame members 14 in a vertical orientation, end cables 60, 62*a* and 64 can be released at one end from end stake 76 and frame members 14 can be laid down upon support surface 12. Side cables 66 are released from support surface 12 and frame members 14 slid in a substantially horizontal orientation over boots 36 and toward wall 92. Frame members 13 can then be pivoted upwardly into a vertical orientation against wall 92, commencing with the frame member closest to wall 92. After all frame members 14 are positioned adjacent wall 92, frame clips 96 can be placed around frame members 14 and secured to wall 92 to prevent the frame members from falling down. Also, a pair of side cables 66 can be used in place of frame clips 96 to secure frame members 14 in position against wall 92. It is understood that during the accordian collapse of cage 10 against wall or fence 92, all of the support cables are disconnected from their anchoring position in support surface 12 and remain attached to frame members 14.

It is also desirable to be able to erect the batting cage indoors to permit year around batting practice despite inclement weather. FIGS. 17–22, 26 and 27 show a cage 110 erected in an indoor arena 111. Cage 110 is substantially identical to batting cage 10 previously described and therefore similar reference numerals are used to designate the structural components of cage 110 which are identical to those described previously with respect to cage 10.

Indoor arenas generally have a floor covering 112 of artificial turf, synthetic material, or wood which is very costly to replace or repair if damaged. Accordingly, it is desirable to protect such floor covering from damage by batting cage 110. Also, the non-skid material 54 on the bottom of boots 36, as previously described, generally does not adhere to artificial turf. A floor mat 114 is provided which allows erection of cage 110 upon any type of floor covering 112 while also protecting the floor covering from any damage. Mat 114 can also be used to erect cage 110 out of doors. Mat 114 is preferably made of vinyl material, however, other materials may also be suitable.

Figure 26:
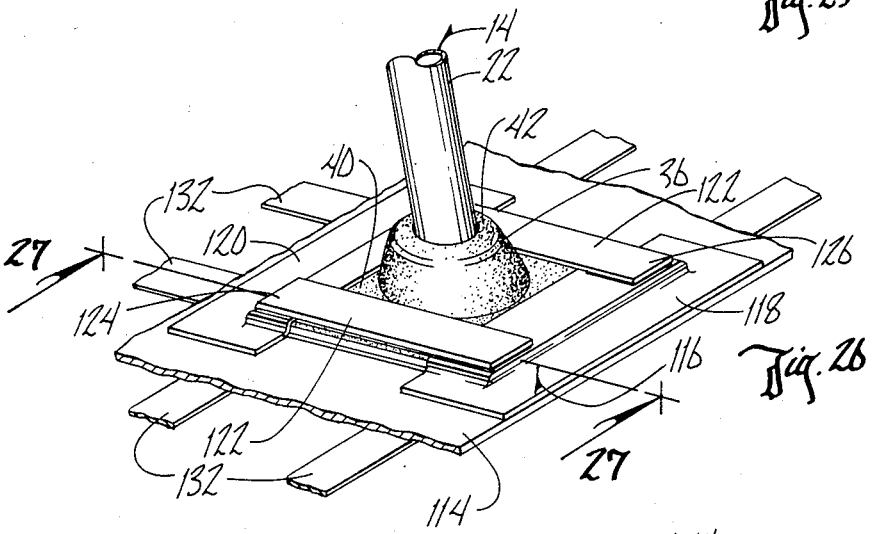
FIG. 26 is a perspective view showing the pocket and the connecting straps of the floor mat.
Figure 27:
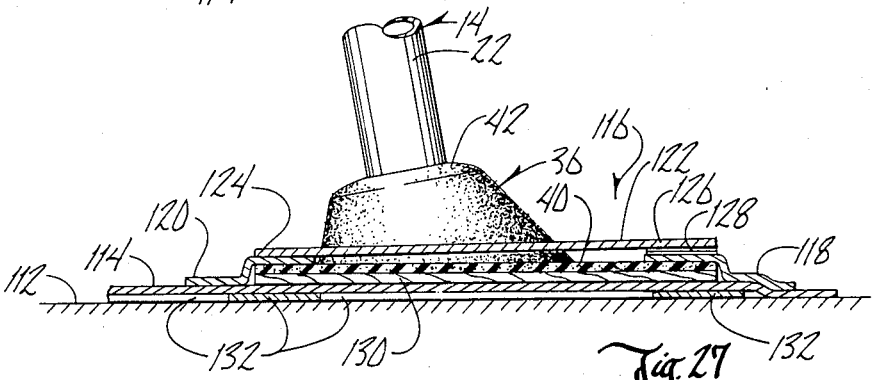
FIG. 27 is a sectional view taken along lines 27—27 of FIG. 26.

As best seen in FIGS. 26 and 27, floor mat 114 includes a plurality of pockets 116, each of which is adapted to receive a boot 36 so as to hold frame members 14 in position. Each pocket 116 includes an outer flap 118 and an inner flap 120, both of which are secured to mat 114 by sewing or any other convenient means. Each pocket 116 also includes opposite side flaps 122 having opposite ends 124 and 126. End 124 is secured to inner flap 122 by sewing or the like, while end 126 is releasably secured to outer flap 118 by velcro material 128 or the like. To insert boot 36 into pocket 116, side flaps 122 are detached from outer flap 118. Base 40 of boot 36 is sufficiently flexible to allow the boot to be temporarily deformed so as to slip into place in pockets 116 between outer flap 118 and inner flap 120. After boot 36 is in the pocket, side flaps 122 are secured to outer flap 118 by Velcro material 128 such that boot 36 is securely held in place within pocket 116. A plate member 130 is located in each pocket 116 beneath boot 36 so as to further protect floor covering 112 from damage.

Figures 17, 18, 19, 20:
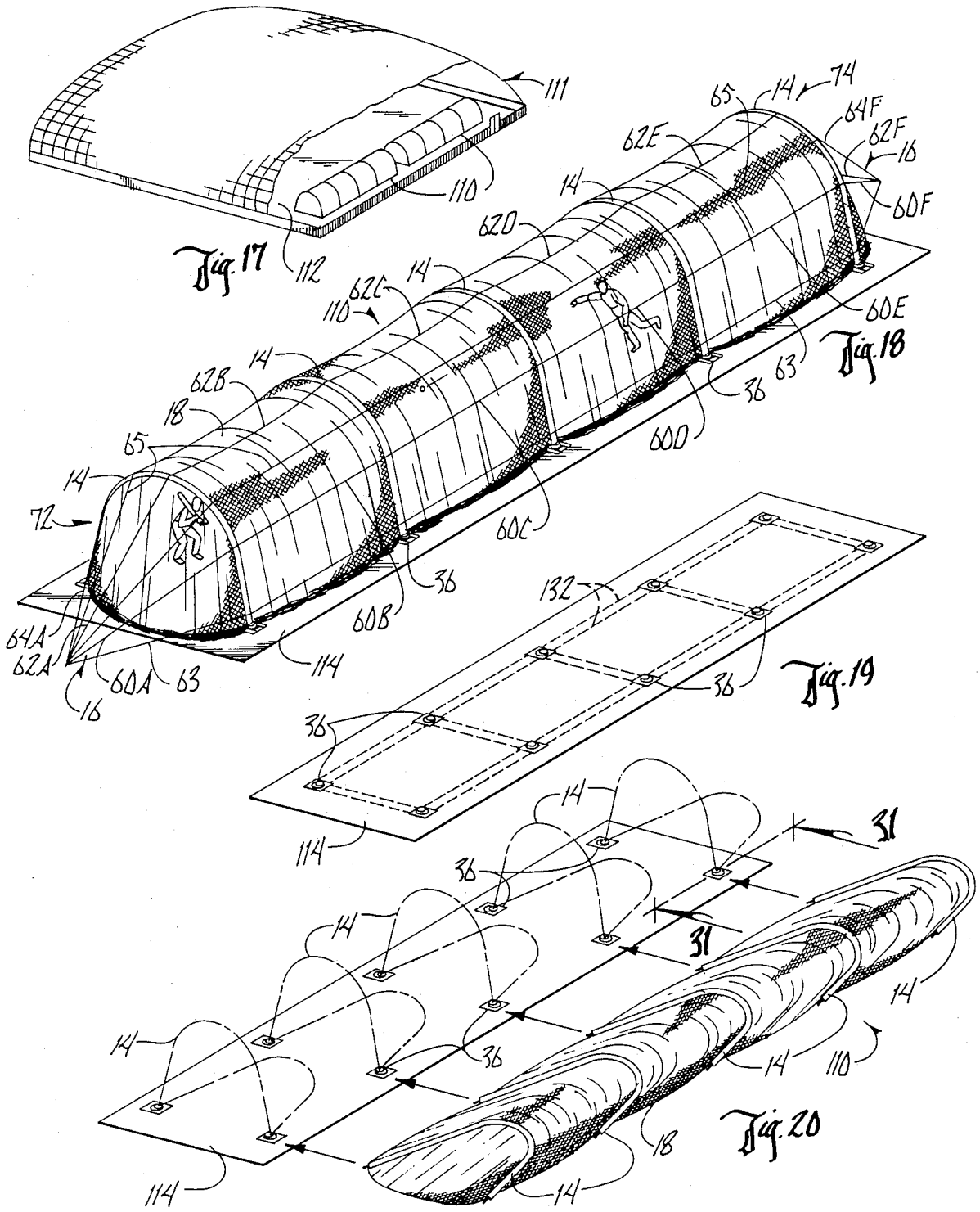
FIG. 17 is a perspective sketch of an indoor arena having two batting cages erected therein end-to-end.
FIG. 18 is a perspective view of the batting cage of the present invention erected on a floor mat.
FIG. 19 is a perspective view of the floor mat having the boots inserted into the pockets therein and showing in broken lines the straps interconnecting each of the pockets.
FIG. 20 is a schematic showing the erection of the batting cage on the floor mat.

As seen in FIGS. 19 and 26, a plurality of straps 132 extend between each pocket 116. Straps 132 are sewn to the bottom of mat 114 so as to prevent stretching of the mat in response to the forces of frame members 14 of cage 110.

The remote ends 68 and 70 of longitudinal cables **60*a*, 62*a*, 64*a*, 60*f*, 62*f* and 64*f* are secured to any convenient fixture located in the wall of arena 111 or in the floor of arena 111, such as a goal post socket 138**.

Figure 12:
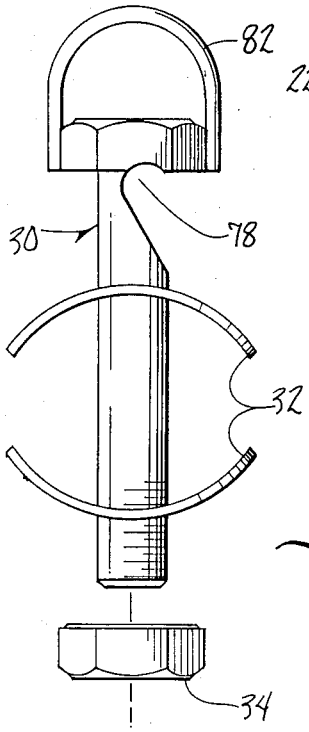
FIG. 12 is an enlarged view of the lock bolt used to couple adjacent pieces of PCV pipe.
Figure 13:
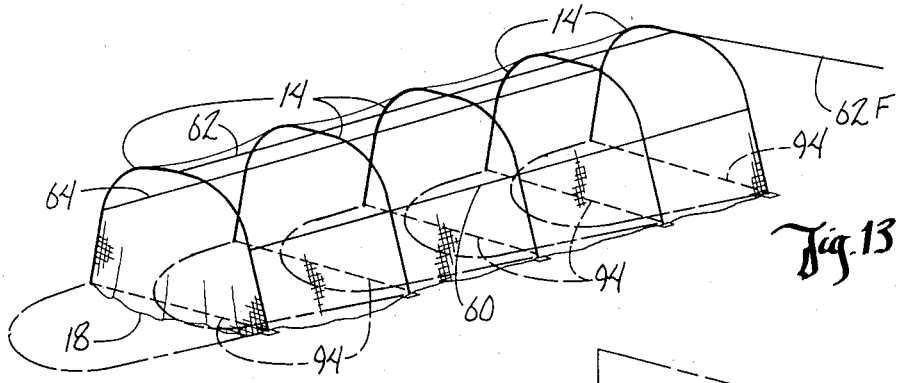
FIGS. 13–16 are schematics progressively showing the accordian-like collapse of the cage after it has been initially set up.
Figure 14:
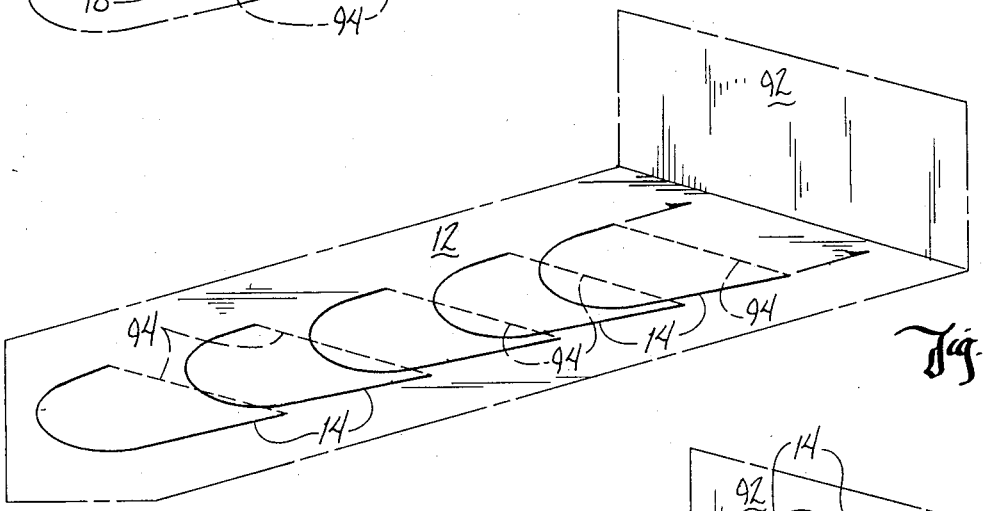
Figure 15:
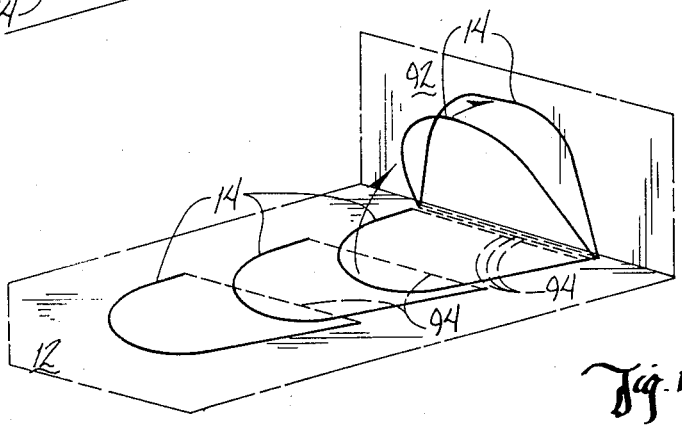
Figure 16:
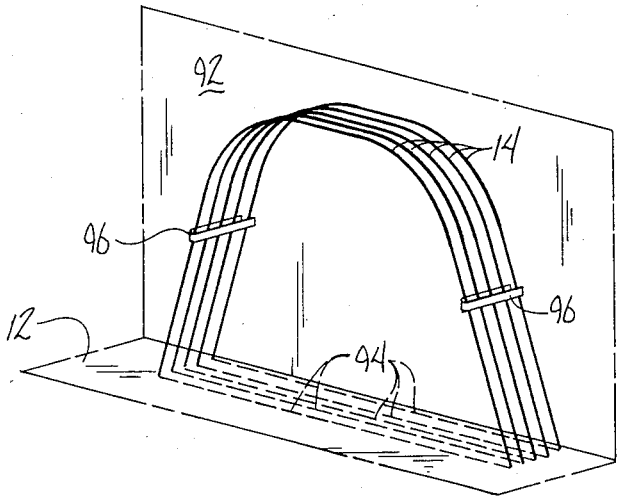
Figure 23:
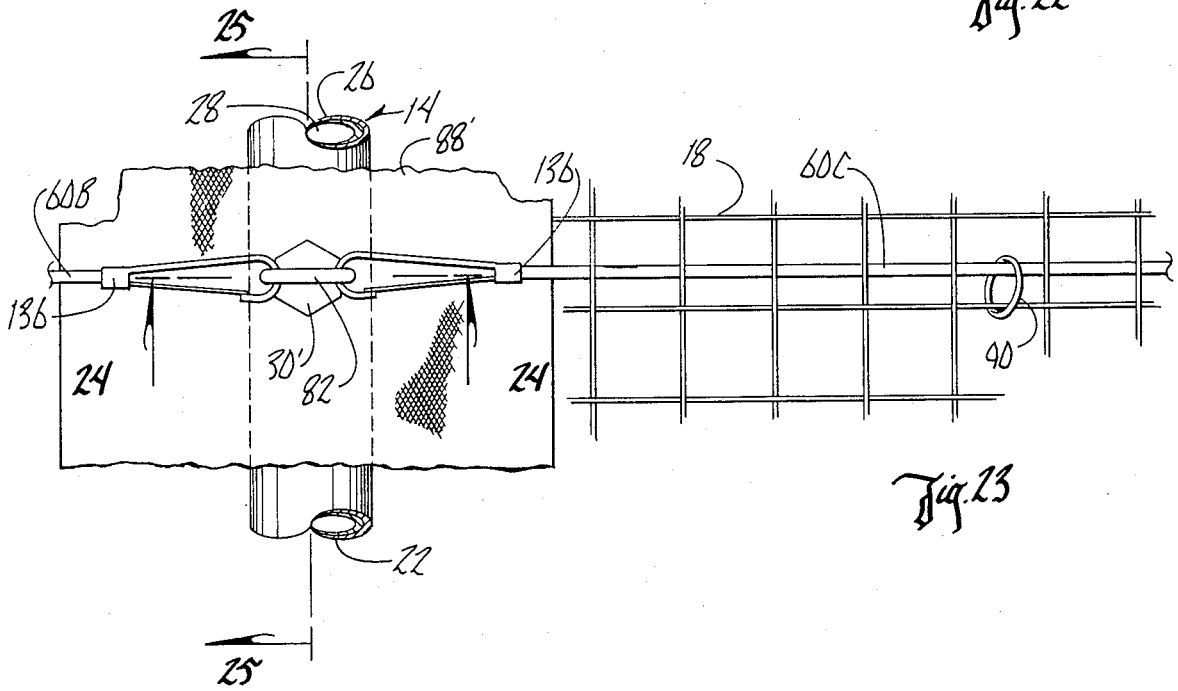
FIG. 23 is an enlarged view taken along lines 23—23 of FIG. 22.
Figure 24:
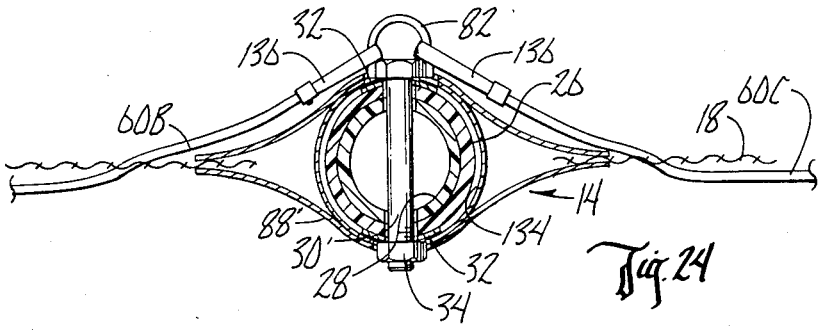
FIG. 24 is a sectional view taken along lines 24—24 of FIG. 23.
Figure 25:
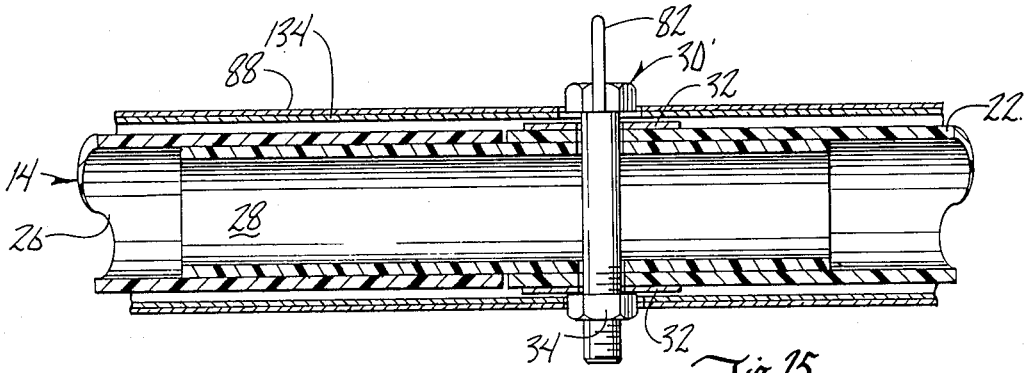
FIG. 25 is a sectional view taken along lines 25—25 of FIG. 23.

Further modifications of cage 110 are shown in FIGS. 23–25, 35 and 36. In particular, as shown in FIG. 24, sleeves 88 are enlarged and are provided with an inner sleeve 134 to provide additional strength to the sleeve. Also, the bolt extending through the frame member and coupler 28, designated by the reference numeral 30', does not include the slot 78 previously described with respect thereto, and shown best in FIG. 12. Furthermore, as shown in FIG. 23, the longitudinal side cables are not continuous lengths of cables, as previously described, but rather, comprise a series of shorter lengths of cables **60*a*–60*f* and 64*a*–64*f*. Each end of cable segments 60*a*–*f* and 64*a*–*f* has a clip 136 for securing the segment to the ring 82 on the respective bolt 30', similar to the connection of longitudinal top cable segments 62*a*–*f*** previously described.

Figure 21:
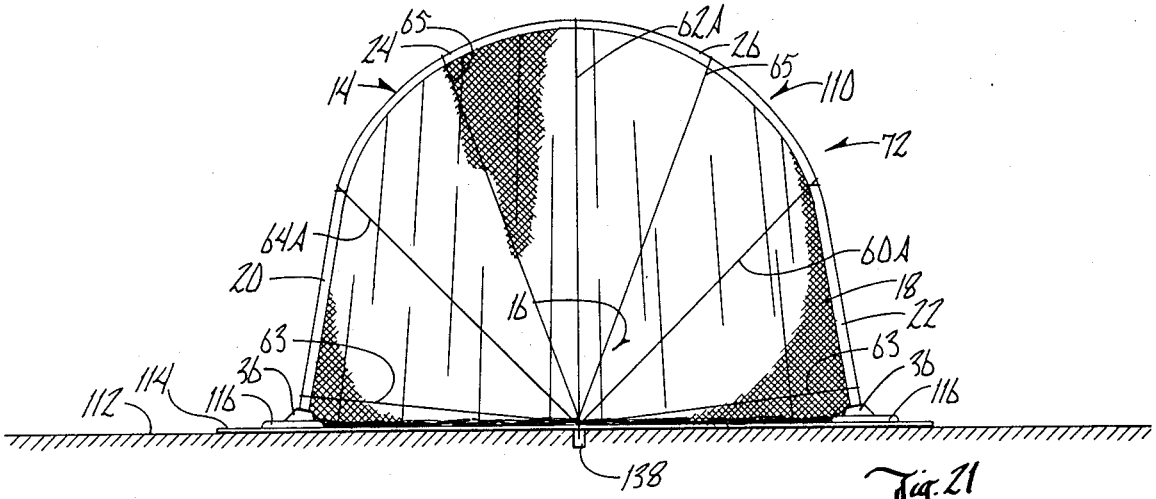
FIG. 21 is an end view of the batting cage.
Figure 22:
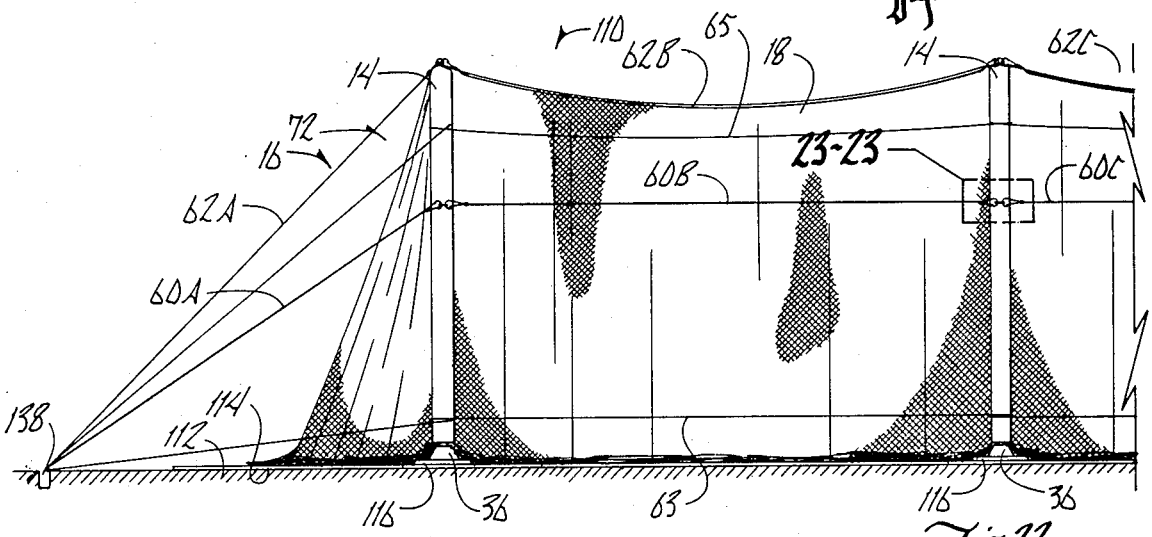
FIG. 22 is a partial side elevational view of the batting cage.
Figure 36:
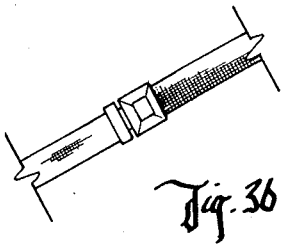
FIG. 36 is a view showing a modified embodiment of the end cable.

An additional modified embodiment of end cable sections 60A, 62A, 64A, 60F, 62F and 64F utilizes a pair of nylon straps connected together by a seat belt-type adjustable fastener for permitting quick and easy adjustment of the cable tension, as shown in FIG. 36. Also, it may be desirable to use additional longitudinal cables 63, 65 as shown in FIGS. 18, 21 and 22 to prevent the loose net 18 from sagging or billowing excessively inwardly. Cables 63 and 65 can be identical to cables 60, 62, 64 or can be continuous cables weaved through net 18, wrapped around each frame member 14 and secured to the opposite end stakes 76 or goal post socket 138.

When cage 10 or 110 is used outdoors, it is also preferable to place a ground plate 140 having a hole therein over stake 76 to prevent legs 20 and 22 from digging into the ground. Plate 140 is preferably not fixed to stake 76, but may be attached to stake 76 by welding or any other convenient manner.

In assembling cage 110 in arena 111, floor mat 114 is spread in covering relation over floor covering 112. Boots 36 are then fit within pockets 116 and side flaps 122 are secured over boots 36. Frame members 14 are assembled and slid into sleeves 88, as previously described. Longitudinal cables **60*a*–*f*, 62*a*–*f* and 64*a*–*f* are then attached to frame members 14 by snapping the end clips to ring 82 on the respective bolt 30' with a portion of the cable being weaved under or through net 18**.

Figure 31:
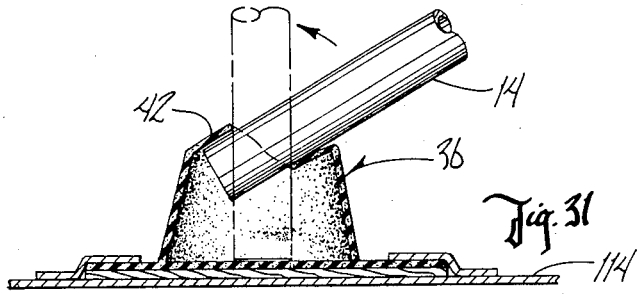
FIG. 31 is a side sectional view taken along line 31—31 of FIG. 20 showing the flexibility of the upper portion of the boot when a leg is being inserted into the boot.

As shown in FIG. 20, the net and framework assembly is slid onto mat 114. The end frame member 14 to which cable **62*a* is attached is then positioned within the respective boot 36 and the free end of cable 62*a* is then anchored to the wall or floor of arena 111 in any convenient manner. As shown in FIG. 31, the upper portion 42 is flexible so as to allow the frame member to be easily inserted into the boot at an angle and then moved to an upright position. The remaining frame members 14 are sequentially positioned in their respective boots 36, while maintaining tension on longitudinal cable 62 until the last frame member is in an upright position and the free end of cable 62*f* is anchored to the wall or floor of arena 111. The free ends of longitudinal side cables 60*a*, 64*a*, 60*f* and 64*f* can be anchored to the wall or floor of arena 111 when cables 62*a* or 62*f* are anchored or can be anchored after all of the frame members 114 are in the upright position. No lateral cables 66** are necessary.

Split rings 90 are then placed around cables 60 and 64 and net 18 at the desired locations.

Batting cage 110 can be disassembled by reversing the steps described above. Also, batting cage 110 can be collapsed in accordian-like fashion against a wall or laid upon the floor without complete disassembly, as described previously. Floor mat 114 can be rolled or folded with boots 36 remaining in pockets 116.

FIGS. 29–30 and 32–34 illustrate the flexible nature of batting cages 10 and 110 which allows the force of a batted ball to be absorbed by the cage structure.

Figures 28, 29, 30:
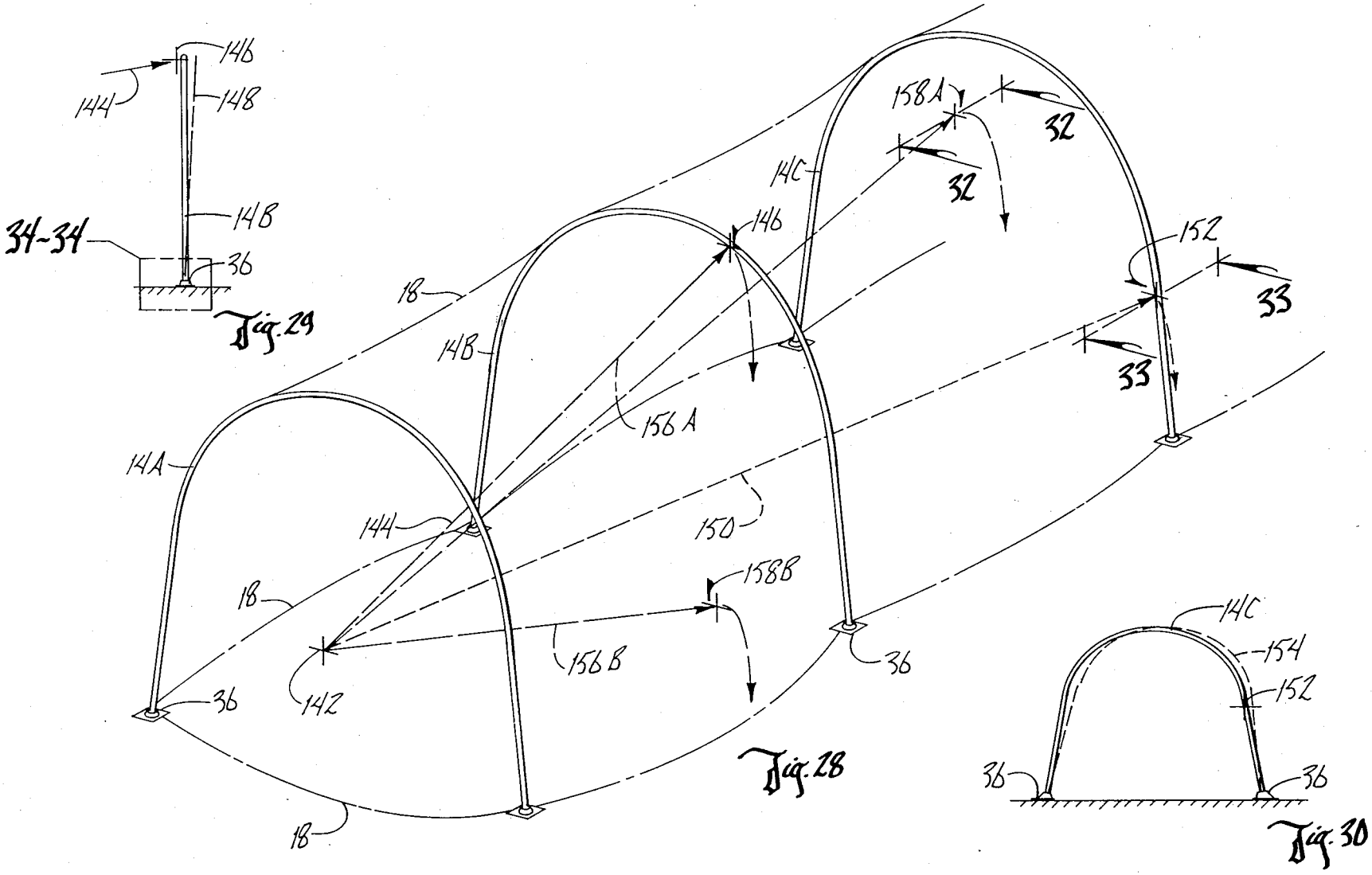
FIGS. 28–30 are schematic views showing the effect of impact of a ball upon the framework of the batting cage.
Figure 33:
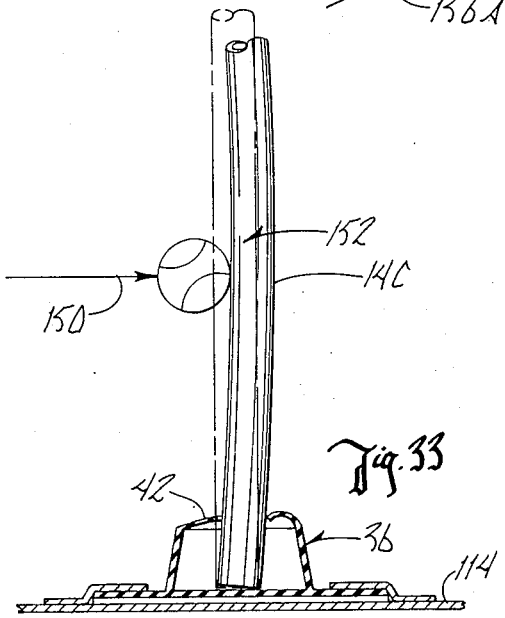
FIG. 33 is another schematic view taken along lines 33—33 of FIG. 28 showing the effect of impact of a ball on the framework of the batting cage.
Figure 34:
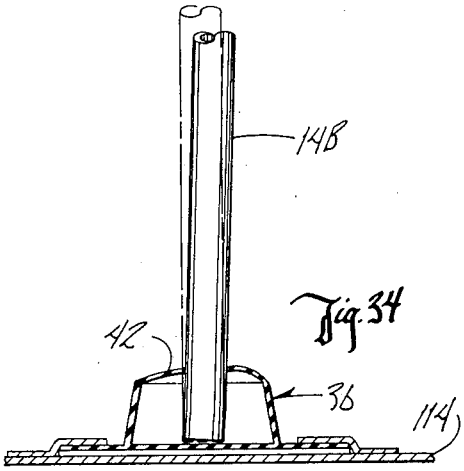
FIG. 34 is an enlarged view taken along lines 34—34 of FIG. 29 and showing the movement of a leg in the boot.
Figure 35:
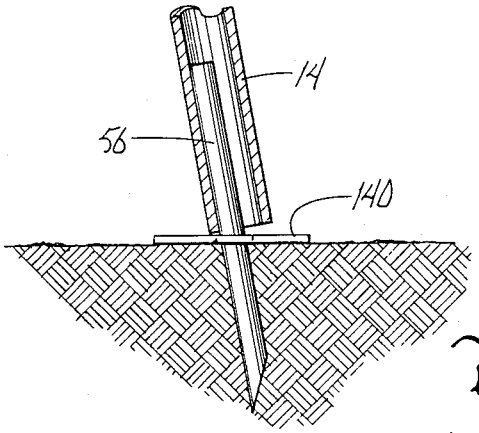
FIG. 35 is a side sectional view similar to FIG. 5 showing a ground plate for preventing the leg from digging into the ground.

For example, a batter standing at point 142 hits a ball along a path designated by arrow 144 so as to hit frame member **14*b* at a point 146, as seen in FIG. 28. Such impact will cause the entire cage, and particularly frame member 14*b*, to deform as shown by the dotted line 148 in FIG. 29, and thereby absorb the energy of the ball. As a further example, when the batter hits another ball along the path indicated by arrow 150 so as to impact upon frame member 14*c* at a point 152, the cage, and particularly frame member 14*c*, will deflect as shown by the dotted line 154 in FIG. 30. In both instances, the frame member also moves within boot 36 due to the resiliency of the upper portion 42 of the boot, as best shown in FIGS. 33 and 34, and moves within sleeve 88 or 88' and inner sleeve 134 due to the slack in the sleeves. Also, when impacted by a ball, the frame member itself flexes or bows momentarily, as best shown in FIG. 33**.

Figure 32:
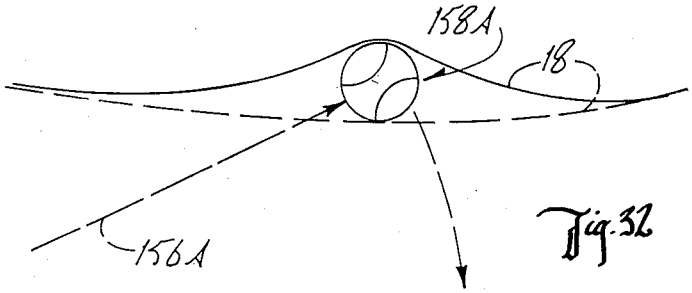
FIG. 32 is a schematic view showing the effect of impact of a ball on the net.

When the batter hits a ball along the path indicated by arrow 156A or 156B in FIG. 28 so as to impact on net 18 at a point 158A or 158B, respectively, net 18 will deflect from its normally draped position shown by dotted lines in FIG. 32 so as to absorb the impact energy of the ball.

Thus, regardless of where the ball impacts upon the cage, the cage will temporarily deform to absorb the forces of impact such that the ball will fall substantially straight down without ricocheting. Also, since the cage is arcuately shaped, the ball always strikes a surface which is at least in part, downwardly presented. Thus, the arcuate shape further contributes to the ball, dropping substantially straight down without substantial ricocheting.

While the present invention has been described as a batting cage for baseball or softball batting practice, it is understood that the cage can be used for any other type of activity wherein it is desirable to stop a ball or object, such as golf practice. The mesh of the net is sized according to the size of the ball which is used in the cage. Also, light, wind and air pass through the net to give the batter a feeling of openness rather than a feeling of being enclosed.

The unique arcuate shape of batting cages 10 and 110 and the construction thereof provide a game-simulating enclosure wherein the exterior elements pass through to the interior of the cage. Furthermore, the cage absorbs the impact energy of a batted ball and thereby causes the ball to drop substantially straight down after impact. Also, the cage stops all balls regardless of the direction the ball is hit without the ball being caught up in the netting, and minimizes ricochet of the ball when it hits a frame member. Batting cages 10 and 110 are portable and can be easily realigned and adjusted by resetting the plurality of cables.

From the foregoing, it can be seen that the present invention accomplishes at least all of the stated objectives.

What is claimed is:

1. An elongated portable batting cage erectable on a support surface having opposite ends whereat a batting station and a pitching station are respectively located, said cage comprising:

an enlarged mat spreadable in covering relation over said support surface;

a plurality of longitudinally spaced apart, arcuately shaped, resilient frame members having opposite ends engaging said mat;

securing means on said mat for holding each of said ends of said frame members in position on said mat;

anchoring means attached to said frame members and attachable to said support surface for maintaining said frame members in an upright position; and a net secured to said frame members so as to hang loosely therefrom and form a normally substantially arch-shaped enclosure having opposite ends and opposite sides;

said frame members being laterally and longitudinally flexible such that said enclosure, upon impact by a ball, momentarily deforms to absorb the impact energy of said ball and thereby cause said ball to fall within said cage without substantial ricocheting, said enclosure automatically returning to said arch shape after the impact energy has been absorbed.

2. The batting cage of claim 1 wherein said securing means includes a plurality of pockets formed in said mat, each of said pockets being adapted to receive one of said ends of said frame members.

3. The batting cage of claim 2 further comprising a boot secured in each of said pockets for receiving one of said ends of said frame members.

4. The batting cage of claim 3 wherein each of said pockets includes means for opening and closing said pocket such that said boot is insertable into and removable from said pocket.

5. The batting cage of claim 4 wherein said means for opening and closing said pocket includes at least one elongated flap having opposite first and second ends, said first end being permanently secured to said mat and said second end being releasably secured to said mat, said flap extending over a portion of said boot when said second end is secured to said mat thereby securing said boot in said pocket.

6. The batting cage of claim 2 wherein said mat further includes a plate means in the bottom of each pocket for protecting said support surface from damage by said ends of said frame members.

7. The batting cage of claim 2 wherein said mat further includes a plurality of straps extending between said pockets for reinforcing said mat.

8. The batting cage of claim 1 wherein said frame members are arcuately shaped.

9. The batting cage of claim 1 wherein said frame members are flexible.

10. The batting cage of claim 1 wherein each of said frame members include a plurality of releasably coupled sections.

11. The batting cage of claim 1 wherein said anchoring means includes at least one elongated flexible cable means extending along the length of said batting cage and being secured to each of said frame members and being secured at opposite ends to said support surface at a point remote from the ends of said enclosure.

12. The batting cage of claim 1 wherein said anchoring means includes a pair of elongated flexible first cable members extending along opposite sides of said enclosure and an elongated flexible second cable member extending along the top of said enclosure, said first and second cable members having opposite ends secured to said support surface at a point remote from the sides of said enclosure, and said first and second cable members being secured to said frame members intermediate said opposite ends thereof.

13. The batting cage of claim 12 wherein said first and second cable members include a plurality of lengths of cable secured to said frame member in end-to-end relation.

14. The batting cage of claim 1 wherein said net includes a plurality of sleeves disposed therein and through which said frame members extend.

15. The batting cage of claim 1 wherein said net has apertures therein the diameter of which is sufficiently small to prevent a ball from passing therethrough and sufficiently large to maintain the exterior environment conditions on the interior of said enclosure.

16. The batting cage of claim 1 wherein a plurality of net clips secure said net to said anchoring means whereby the shape of said enclosure is maintained.

17. A method of assembling an elongated portable batting cage upon a support surface, said cage being formed by a normally substantially semi-cylindrical shaped enclosure having opposite ends whereat a batting station and a pitching station are respectively located, said cage comprising a plurality of longitudinally spaced apart, arcuately shaped, resilient frame members having opposite ends; at least one elongated flexible cable means for anchoring said frame members on said support surface; and a net having a plurality of sleeves disposed therein, said method comprising:

spreading an enlarged mt in covering relation over a support surface, said mat having opposite ends and opposite sides, and having a plurality of pockets formed therein along the length thereof and adjacent the opposite sides thereof;

inserting one of said frame members into each of said sleeves in said net such that the ends of said frame members protrude from said sleeve;

connecting said cable means to said plurality of frame members;

inserting the opposite ends of the first of said plurality of frame members into said pockets at one end of said mat and standing said first frame member into an upright position;

anchoring one end of said cable means to said support surface at a position remote from said first frame member;

sequentially inserting the opposite ends of each successive frame member into the respective pockets and standing said frame members into an upright position while maintaining tension on said cable means; and anchoring the other end of said cable means to said support surface at a position remote from the last of said frame members.

18. The method of claim 17 wherein the steps are reversed to disassemble said batting cage.

19. The method of claim 17 wherein said batting cage can be collapsed by releasing one end of said cable means from the anchored position and removing said frame members from said pockets.

20. The method of claim 19 wherein said collapsing further includes moving said frame members toward the opposite end of said cable means.

21. The method of claim 20 wherein said frame members are moved off of said mat and said mat is removed from said covering relation over said support surface.

22. An elongated, portable cage for ball sports comprising:

a plurality of arcuately shaped frame members having opposite ends supported by a support surface;

a plurality of anchoring means attached directly to said frame members and attachable to said support surface for maintaining said frame members in an upright position;

a net secured to said frame members having excess material between said frame members so as to hang loosely therefrom and form an elongated arch-shaped enclosure having opposite sides and opposite ends; and said frame members being laterally and longitudinally flexible and moveable substantially unrestricted by said net and said anchoring means such that said enclosure temporarily deforms upon impact by a ball so as to absorb the forces of impact and thereby cause said ball to fall within said enclosure without substantial ricocheting, said enclosure automatically returning to said arch shape after absorption of said forces.

23. The cage of claim 22 wherein each of said frame members has an apex and said opposite ends of each frame assembly diverge downwardly from said apex so that the ball is always deflected downwardly after impacting said frame members.

24. The cage of claim 22 wherein said opposite ends of said frame members are movable with respect to said support surface to allow said enclosure to absorb the impact energy of the ball.

25. The cage of claim 22 wherein said net includes a plurality of sleeves disposed therein and through which said frame members extend.

26. The cage of claim 25 wherein each of said frame members are movable within said sleeve to allow said enclosure to absorb the energy of impact of the ball.

27. The cage of claim 22 further comprising a plurality of boots having an open upper collar for receiving one end of one of said frame members and a bottom surface for frictionally securing said boot member to said support surface.

28. The cage of claim 27 wherein said ends of said frame members are received within said collar of said boots so as to be movable within said collar and thereby allow said enclosure to absorb the energy of impact of the ball.

29. The cage of claim 22 wherein said net is excessively large so as to have a perimeter portion which extends beyond the ends of said frame member and is loosely accumulatable on said support surface to allow said enclosure to absorb the impact energy of the ball.

30. The cage of claim 22 wherein said net is light and air permeable such that the inside of said enclosure is exposed to conditions existing on the outside of said enclosure without substantial interference by said net.

31. The cage of claim 22 further comprising an enlarged mat for covering the support surface, said mat having securing means thereon for holding each of the ends of said frame members in position on the mat such that said mat is positioned between said frame members and said support surface to prevent damage to the support surface.

32. The cage of claim 31 wherein said securing means includes a plurality of pockets formed in said mat, each of said pockets being adapted to receive one of said ends of said frame members.

* * * * *